US009354602B2

(12) United States Patent
Yamashita et al.

(10) Patent No.: US 9,354,602 B2
(45) Date of Patent: May 31, 2016

(54) IMAGE FORMING APPARATUS AND DUCT

(71) Applicant: KYOCERA Document Solutions Inc., Osaka-shi, Osaka (JP)

(72) Inventors: Kazuya Yamashita, Osaka (JP); Masato Onishi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/424,413

(22) PCT Filed: Jul. 30, 2014

(86) PCT No.: PCT/JP2014/070013
§ 371 (c)(1),
(2) Date: Feb. 26, 2015

(87) PCT Pub. No.: WO2015/037355
PCT Pub. Date: Mar. 19, 2015

(65) Prior Publication Data

US 2016/0004215 A1 Jan. 7, 2016

(30) Foreign Application Priority Data

Sep. 12, 2013 (JP) ..... 2013-189792

(51) Int. Cl.

| | |
|---|---|
| ***G03G 21/20*** | (2006.01) |
| ***B41J 29/377*** | (2006.01) |
| ***G03G 15/00*** | (2006.01) |
| ***G03G 15/20*** | (2006.01) |
| ***G03G 21/00*** | (2006.01) |
| ***B41J 29/02*** | (2006.01) |
| ***B41J 29/13*** | (2006.01) |

(52) U.S. Cl.
CPC ..... *G03G 21/206* (2013.01); *B41J 29/02* (2013.01); *B41J 29/13* (2013.01); *B41J 29/377* (2013.01); *G03G 15/00* (2013.01); *G03G 15/20* (2013.01); *G03G 21/00* (2013.01); *G03G 21/20* (2013.01)

(58) Field of Classification Search
CPC ..... G03G 21/206; G03G 21/0052; G03G 2221/1645
See application file for complete search history.

(56) References Cited

U.S. PATENT DOCUMENTS

| | | | | |
|---|---|---|---|---|
| 2006/0182461 | A1* | 8/2006 | Imada | G03G 21/206 399/92 |
| 2009/0152964 | A1* | 6/2009 | Hui | H02K 9/04 310/63 |
| 2009/0308579 | A1* | 12/2009 | Johnson | H05K 7/20836 165/104.34 |

FOREIGN PATENT DOCUMENTS

| | | | |
|---|---|---|---|
| JP | 2001125443 | A | 5/2001 |
| JP | 2004272089 | A | 9/2004 |
| JP | 2008070744 | A | 3/2008 |
| JP | 2010107694 | A | 5/2010 |

* cited by examiner

*Primary Examiner* — David Gray
*Assistant Examiner* — Sevan A Aydin
(74) *Attorney, Agent, or Firm* — Alleman Hall McCoy Russell & Tuttle LLP

(57) ABSTRACT

Image forming apparatus (1) including: external cover (63) covering outer side of side wall of housing (60) storing image forming portion (20), and having exhaust outlet (63*f*); equipment storage space (5) formed between side wall (62*a*) of housing (60) and external cover (63); opening (62*f*) formed in side wall (62*a*) and allowing inside of housing (60) to communicate with equipment storage space (S); exhaust fan (100) disposed in equipment storage space (S) and taking in air from housing (60) via opening (62*f*) and exhausting air from exhaust outlet (63*f*); heat generating equipment (70) disposed in equipment storage space (S); and duct (90) connecting air outlet (101*b*) of exhaust fan (100) and exhaust outlet (63*f*). Communicating portion (97), which allows inside and outside of duct (90) to communicate with each other, is formed in wall of duct (90) located on heat generating equipment (70) side.

6 Claims, 9 Drawing Sheets

PRINTER LEFT/RIGHT DIRECTION

LEFT ⟷ RIGHT

IMAGE FORMING APPARATUS AND DUCT

TECHNICAL FIELD

The present disclosure relates to an image forming apparatus and a duct.

BACKGROUND ART

Conventionally, there is known an image forming apparatus in which an exhaust fan is stored in a space between a side wall of a housing of the image forming apparatus and an external cover (see, for example, Patent Literature 1). The housing stores an image forming portion for forming an image on a paper sheet. The image forming portion includes, for example, a fixing unit for fixing toner onto a recording sheet by heat, and the like. The exhaust fan is attached to the side wall of the housing. The exhaust fan discharges a high-temperature air warmed by the heat of the image forming portion (in particular, the fixing unit) to the outside from an exhaust outlet formed in the external cover. Heat generating equipments such as an electric board and the like, as well as the exhaust fan, are stored in the space between the side wall of the housing and the external cover.

CITATION LIST

Patent Literature

[PTL 1] Japanese Laid-Open Patent Publication No. 2004-272089

SUMMARY OF THE INVENTION

Problems to be Solved by the Invention

Meanwhile, to prevent occurrence of failures, it is desirable to cool the heat generating equipments, which include a motor, an electromagnetic clutch and the like, as well as the electric board.

However, according to the conventional image forming apparatus disclosed in Patent Literature 1, after the high-temperature air warmed by the heat of the image forming portion (in particular, the fixing unit) is sucked out from the inside of the housing by the exhaust fan, a part of the high-temperature air does not flow toward the exhaust outlet, but flows toward the heat generating equipments. As a result, far from being cooled, the heat generating equipments are further heated by the high-temperature air warmed by the heat of the image forming portion. As a result, the duct of the conventional image forming apparatus has a problem that it makes the heat generating equipments easily fail.

As a countermeasure for this problem, an additional exhaust fan may be disposed in the vicinity of the heat generating equipments such that the high-temperature air does not remain around the heat generating equipments. However, this configuration has a problem that as the number of exhaust fans increases, it increases the cost as well.

The present invention has been made in view of such conventional circumstances, and it is an object of the present invention to provide an inexpensive configuration for discharging heat from the inside of the housing, and preventing high-temperature air from remaining around the heat generating equipments.

Solution to the Problems

An image forming apparatus according to an aspect of the present invention includes a housing, an external cover, an equipment storage space, an opening, an exhaust fan, a heat generating equipment, and a duct. The housing stores an image forming portion configured to form an image on a recording medium. The external cover covers an outer side of a side wall of the housing. The external cover has an exhaust outlet formed therein. The equipment storage space is formed between the side wall of the housing and the external cover. The opening is formed in the side wall and allows inside of the housing to communicate with the equipment storage space. The exhaust fan is disposed in the equipment storage space and takes in air from the housing via the opening and exhausts the air from the exhaust outlet formed in the external cover. The heat generating equipment is disposed in the equipment storage space. The duct connects an air outlet of the exhaust fan and the exhaust outlet formed in the external cover. A communicating portion, which allows inside and outside of the duct to communicate with each other, is formed in a wall of the duct, the wall being located on the heat generating equipment side.

A duct according to another aspect of the present invention is provided in an equipment storage space that is provided between a side wall of a housing and an external cover and stores a heat generating equipment, the housing storing an image forming portion configured to form an image on a recording medium, the external cover covering an outer side of the side wall of the housing and having an exhaust outlet formed therein. The side wall has an opening that allows inside of the housing to communicate with the equipment storage space. An exhaust fan, which is configured to take in air from the housing via the opening and exhaust the air from the exhaust outlet formed in the external cover, is disposed in the equipment storage space. The duct includes a duct main body connecting an air outlet of the exhaust fan and the exhaust outlet formed in the external cover. A communicating portion, which allows inside and outside of the duct to communicate with each other, is formed in a wall of the duct main body, the wall being located on the heat generating equipment side.

Advantageous Effects of the Invention

According to the present invention, it is possible to provide an inexpensive configuration for discharging heat from the inside of the housing, while preventing high-temperature air from remaining around the heat generating equipments.

DESCRIPTION OF EMBODIMENTS

Hereinafter, embodiments of the present invention will be described in detail with reference to the drawings. It should be noted that the present invention is not limited to the following embodiments.

Embodiment 1

Figure 1:
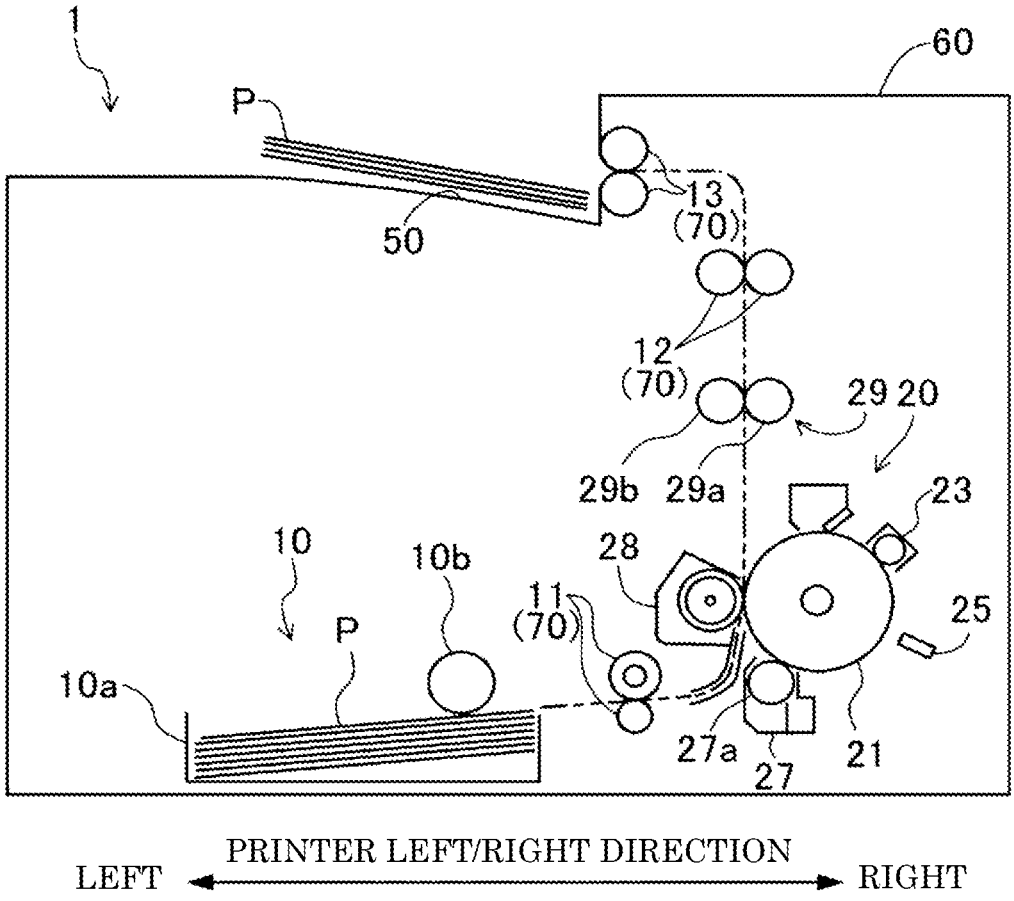
FIG. 1 is a schematic cross-sectional view of a printer, viewed from the front side thereof, as an image forming apparatus in Embodiment 1 of the present invention.

FIG. 1 shows a laser printer 1 (hereinafter, merely referred to as "printer 1") as the image forming apparatus in the present embodiment. The printer 1 includes a sheet feed portion 10, an image forming portion 20, a sheet discharge portion 50, and a housing 60. A plurality of pairs of conveying rollers 11-13 for nipping and conveying a paper sheet P are provided in a sheet conveyance path extending from the sheet feed portion 10 to the sheet discharge portion 50. It is noted that in the following description, the front and depth sides of the paper surface in FIG. 1 are referred to as "front side" and "rear side", respectively, and the left and right sides of the paper surface in FIG. 1 are referred to as "left side" and "right side", respectively.

The sheet feed portion 10 is disposed in the housing 60 at a lower position. The sheet feed portion 10 includes a sheet feed cassette 10*a* and a pick-up roller 10*b*. The sheet feed cassette 10*a* stores paper sheets P. The pick-up roller 10*b* picks up a paper sheet P from the sheet feed cassette 10*a* and feeds it to the outside of the sheet feed cassette 10*a*. The paper sheet P fed to the outside of the sheet feed cassette 10*a* is supplied to the image forming portion 20 via a pair of conveying rollers 11.

The image forming portion 20 includes a photoconductor drum 21, a charging unit 23, an exposure device 25, a developing device 27, a transfer unit 28, a fixing unit 29, and a toner container (not shown), wherein the photoconductor drum 21 is an example of the image carrying member. The image forming portion 20 causes the charging unit 23 to charge the circumferential surface of the photoconductor drum 21, then causes the exposure device 25 to form an electrostatic latent image on the photoconductor drum 21 by irradiating the surface of the photoconductor drum 21 with laser light based on the document sheet image data (for example, image data of a document sheet image received from an external terminal). The electrostatic latent image formed (carried) on the surface of the photoconductor drum 21 is developed by the developing device 27 as a toner image. Subsequently, the image forming portion 20 causes the transfer unit 28 to transfer the toner image to the paper sheet P supplied from the sheet feed portion 10, and supplies the paper sheet P after the transfer to the fixing unit 29.

The fixing unit 29 includes a fixing roller 29*a* and a pressure roller 29*b* that are disposed to face each other. A heater is embedded in the fixing roller 29*a*. In the fixing unit 29, the paper sheet P supplied from the image forming portion 20 is pressed between the fixing roller 29*a* and the pressure roller 29*b*, thereby the toner image is thermally fixed to the paper sheet P. The paper sheet P, to which the toner image has been thermally fixed by the fixing unit 29, is conveyed by the rollers 29*a* and 29*b* toward the downstream side. The paper sheet P output from the fixing unit 29 is discharged to the sheet discharge portion 50 via the plurality of pairs of conveying rollers 12, 13.

Figure 2:
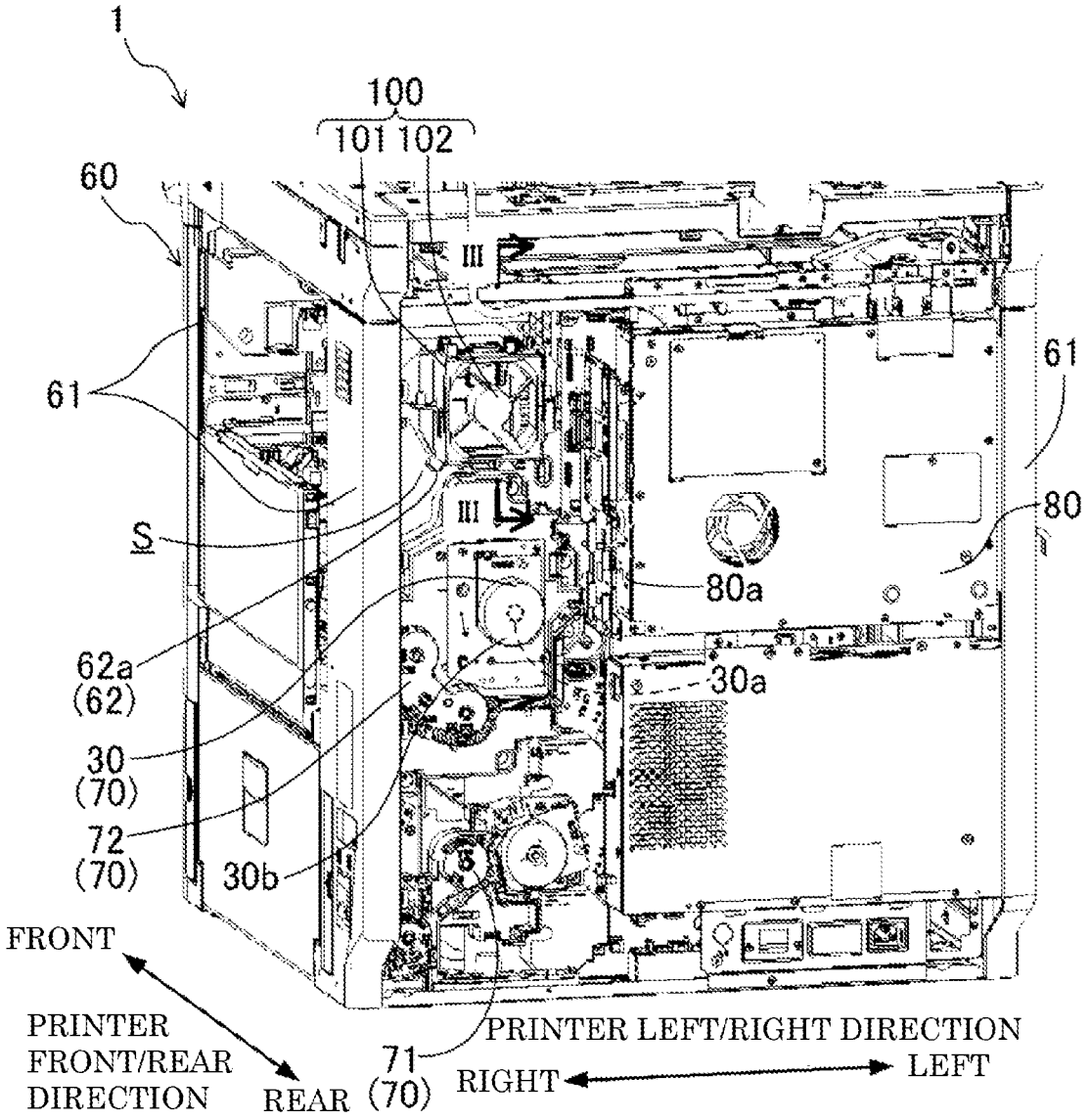
FIG. 2 is a perspective view of the printer in Embodiment 1 of the present invention, viewed diagonally from the upper right of rear side thereof.

As shown in FIG. 2, the housing 60 includes a frame 61 and sheet metals 62. In the whole view, the housing 60 has an approximate rectangular parallelepiped shape, and the frame 61 constitutes the framework of the housing 60. Six sheet metals 62 are provided in total, and the sheet metals 62 form the front and rear, left and right, and upper and lower walls respectively. FIG. 2 shows only a sheet metal 62*a* which forms the rear wall of the housing 60 (hereinafter this sheet metal is referred to as "rear sheet metal").

Figure 3:
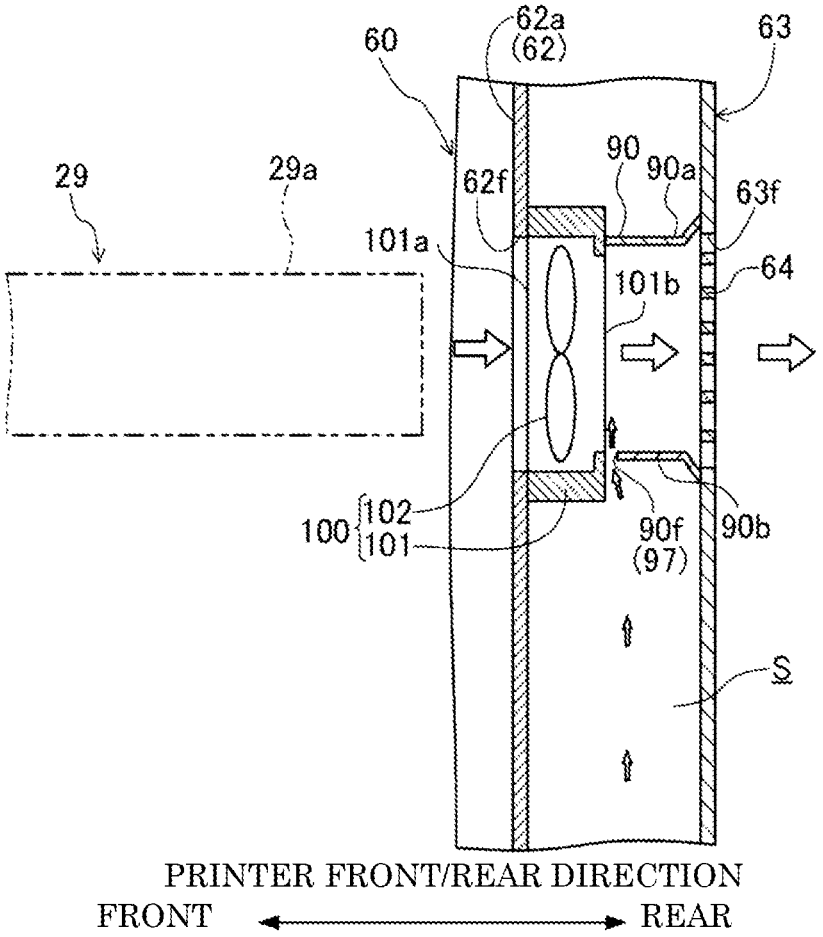
FIG. 3 is a schematic cross-sectional view taken along the III-III line of FIG. 2.

As shown in FIG. 3, the rear sheet metal 62*a* is disposed at a position close to the fixing unit 29 which is a component of the image forming portion 20. The rear sheet metal 62*a* is covered with an external cover 63 provided in the outside of the printer 1. The external cover 63 is fixed to the frame 61 (see FIG. 2) by bolts (not shown). A rectangular-shaped exhaust outlet 63*f* is provided in an upper-left part of the external cover 63. The exhaust outlet 63*f* is covered with a louver 64. The external cover 63 is disposed in rear of the rear sheet metal 62*a*, separated by a predetermined distance therefrom. In addition, there is formed, between the external cover 63 and the rear sheet metal 62*a*, an equipment storage space S having a thickness in the front-rear direction.

Back to FIG. 2, in the equipment storage space S, an exhaust fan 100, a drum driving motor 30, a conveyance clutch 72, a sheet feed conveyance motor 71, a board box 80, and the like are disposed. These equipments are fixed to a surface of the rear sheet metal 62*a* on the external cover 63 side, by bolts or the like.

The board box 80 is attached to an upper-left (upper-right, in FIG. 2) part of the rear sheet metal 62*a*. The board box 80 stores various boards such as a power board, an engine board, a main board, and the like.

The exhaust fan 100 is attached to an upper-right (upper-left, in FIG. 2) part of the rear sheet metal 62*a*. The exhaust fan 100 includes a fan casing 101 and an impeller 102 stored in the fan casing 101. The fan casing 101 is composed of a case in the shape of a rectangular box. An air inlet 101*a* (see FIG. 3) is provided in the front surface of the fan casing 101, and an air outlet 101*b* is provided in the rear surface of the fan casing 101. The exhaust fan 100 is configured to generate, with the rotation of the impeller 102, an airflow that mainly flows from the front side to the rear side. The fan casing 101 is attached to the rear sheet metal 62*a* such that the air inlet 101*a* overlaps (mates) with an opening 62*f* formed in the rear sheet metal 62*a*. The opening 62*f* is formed in the rear sheet metal 62*a* at a position close to the fixing roller 29*a*. The space of the inside of the housing 60 communicates with the equipment storage space S via the opening 62*f*.

The drum driving motor 30 is a motor for driving the photoconductor drum 21. The drum driving motor 30 includes an output shaft 30*a* (see FIG. 2), a rotor 30*b*, and a starter (not shown). The rotor 30*b* is cylindrical and integrally rotatably coupled with the output shaft 30*a* in the equipment storage space S. The starter is disposed coaxially with the rotor 30*b*. The output shaft 30*a* penetrates through the rear sheet metal 62*a*, and an end of the output shaft 30*a* is integrally rotatably coupled with the photoconductor drum 21. When the drum driving motor 30 is activated, it is heated since a coil thereof is electrically conducted. In addition, when the drum driving motor 30 is activated, it is heated due to the friction of the bearing.

The conveyance clutch 72 is configured to switch between a power transmission state and a power interruption state. In the power transmission state, the conveyance clutch 72 transmits the power of a conveyance motor (not shown) to the pairs of conveying rollers 12, 13. In the power interruption state, the conveyance clutch 72 interrupts the transmission of the power. The conveyance clutch 72 is composed of an electromagnetic clutch. A controller (not shown) controls the conductive state and non-conductive state of an excitation coil of the conveyance clutch 72. When the excitation coil is in the conductive state, the power of the conveyance motor is transmitted to the pairs of conveying rollers 12, 13 via the conveyance clutch 72. On the other hand, when the excitation coil is in the non-conductive state, the transmission of the power is interrupted. The conveyance clutch 72 is heated when the excitation coil is electrically conducted by the controller.

The sheet feed conveyance motor 71 is a motor for driving the pick-up roller 10*b*. The sheet feed conveyance motor 71 is activated and controlled by the controller. When the sheet feed conveyance motor 71 is activated, it is heated since a coil thereof is electrically conducted. In addition, when the sheet feed conveyance motor 71 is activated, it is heated due to the friction of the bearing.

The above-described drum driving motor 30, conveyance clutch 72, and sheet feed conveyance motor 71 are heat generating equipments 70 stored in the equipment storage space S, and these heat generating equipments 70 are disposed below a duct 90 which is described below.

Figure 4:
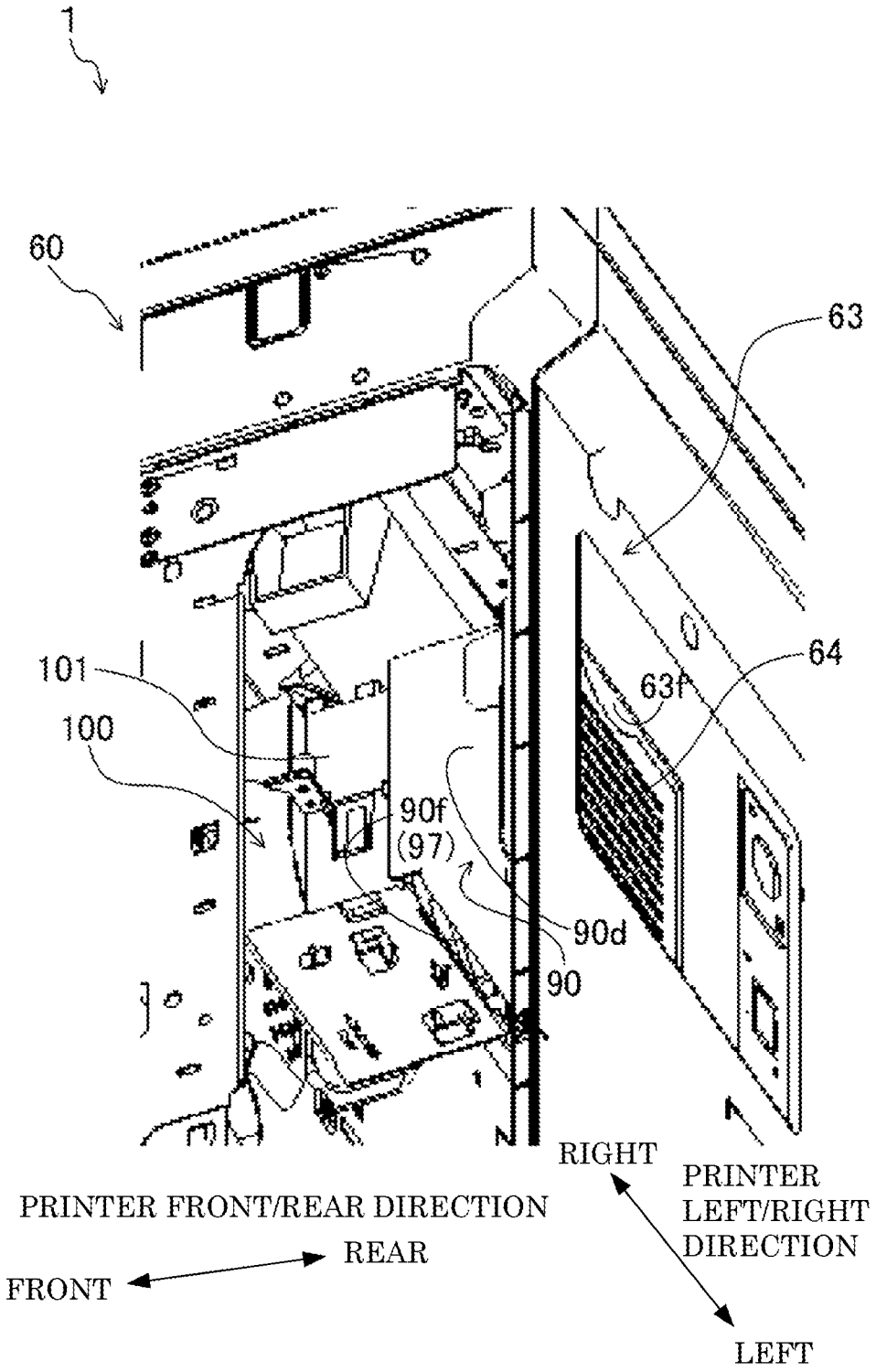
FIG. 4 is an enlarged view of a peripheral part of an exhaust fan in the equipment storage space of the printer in Embodiment 1 of the present invention.
Figure 5:
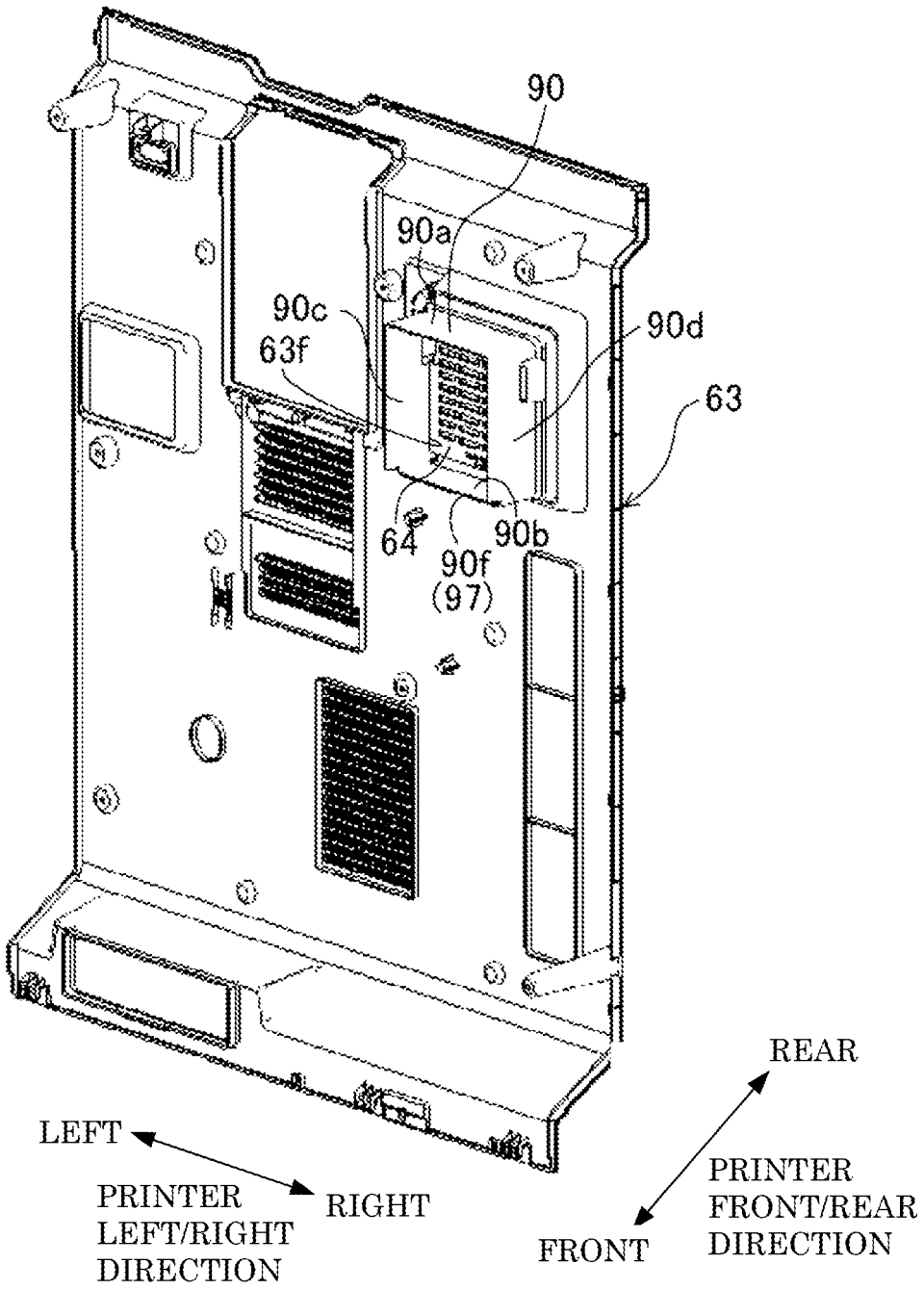
FIG. 5 is a perspective view of an external cover covering the rear side of the printer in Embodiment 1 of the present invention, viewed diagonally from the right of the front side of the printer.

As shown in FIGS. 3 to 5, the air outlet 101*b* of the exhaust fan 100 and the exhaust outlet 63*f* formed in the external cover 62 are connected with each other via the duct 90. The duct 90 is formed in a shape of a rectangular frame extending in the front-rear direction. A rear end of the duct 90 is fixed to the peripheral edge of the exhaust outlet 63*f* formed in the external cover 63 (see FIG. 5). It is noted that, with the attachment of the external cover 62 to the housing 60, the whole part of a front end of the duct 90, except for a cut 90*f* (described below), abuts the peripheral edge of the air outlet 101*b* of the exhaust fan 100 (see FIG. 3).

Figure 6:
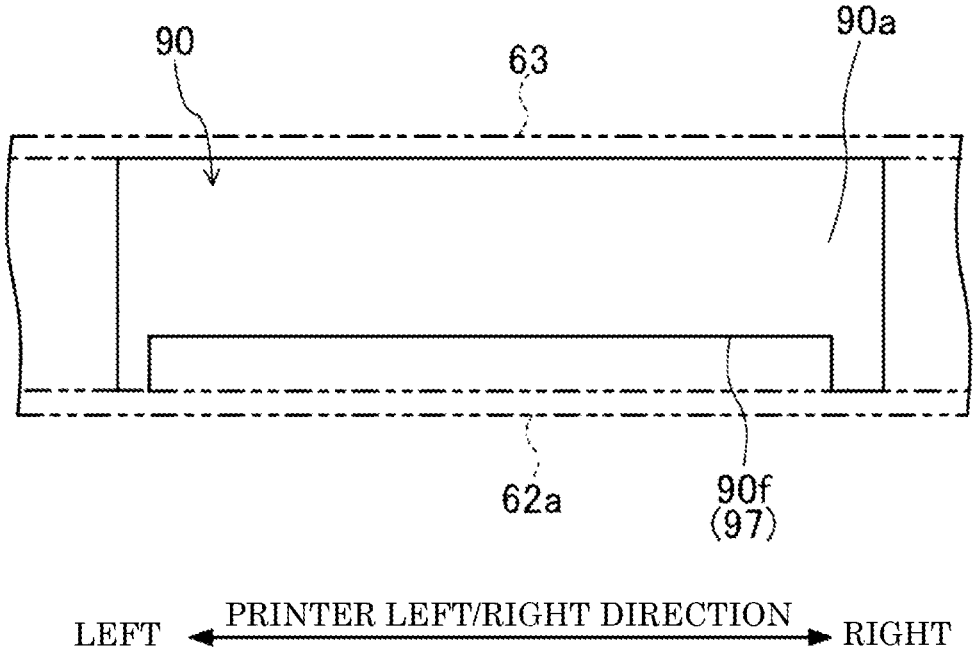
FIG. 6 is a schematic plan view, viewed from below, of a cut formed as a communicating portion in the duct in Embodiment 1 of the present invention.

The duct 90 includes a top wall 90*a*, a bottom wall 90*b*, a left wall 90*c*, and a right wall 90*d*. The top wall 90*a* and the bottom wall 90*b* face each other in the up-down direction. The left wall 90*c* and the right wall 90*d* face each other in the left-right direction. The cut 90*f* is formed in, among the walls of the duct 90, the bottom wall 90*b* which is located on the heat generating equipments (in the present embodiment, the drum driving motor 30, conveyance clutch 72, and sheet feed conveyance motor 71) side. As shown enlarged in FIG. 6, the cut 90*f* is formed at the center of a front end of the bottom wall 90 in the left-right direction. In a plan view, the cut 90*f* is opened toward the front side, and is elongated in the left-right direction. The cut 90*f* functions as a communicating portion 97 that allows the inside and outside of the duct 90 to communicate with each other.

In the printer 1 configured as described above, when the exhaust fan 100 is activated, high-temperature air in the housing 60 heated by the heat of the fixing roller 29*a* is guided through the opening 61*d* formed in the rear wall 62*a* to the air inlet 101*a* of the fan casing 101 (see FIG. 3). The air then flows into the fan casing 101 from the air inlet 101*a*, flows into the duct 90 from the air outlet 101*b* of the fan casing 101, and then after flowing through the duct 90, is discharged to the outside of the printer 1 from the exhaust outlet 63*f* formed in the external cover 63. During this operation, in the duct 90, an airflow flowing from the housing 60 side to the exhaust outlet 63*f* side (from the front side to the rear side) at a relatively high speed is formed. As a result, high-temperature air that remains around the heat generating equipments 70 (in the present embodiment, the drum driving motor 30, conveyance clutch 72, and sheet feed conveyance motor 71) is dragged by the high-speed airflow and caused to flow into the duct 90 from the cut 90*f* formed in the bottom wall 90*b* of the duct 90. The high-temperature air that has flown into the duct 90 is discharged from the exhaust outlet 63*f*, together with the high-speed airflow. As a result, it is possible to prevent the high-temperature air from remaining around the heat generating equipments 70, and prevent the heat generating equipments 70 from failing. In this configuration, since the exhaust fan 100, which is originally aimed to exhaust heat from the housing 60, is used to prevent air from remaining around the heat generating equipments 70, there is no need to install an additional exhaust fan. As a result, it is possible to reduce the product cost by restricting increase in the number of parts.

Embodiment 2

Figure 7:
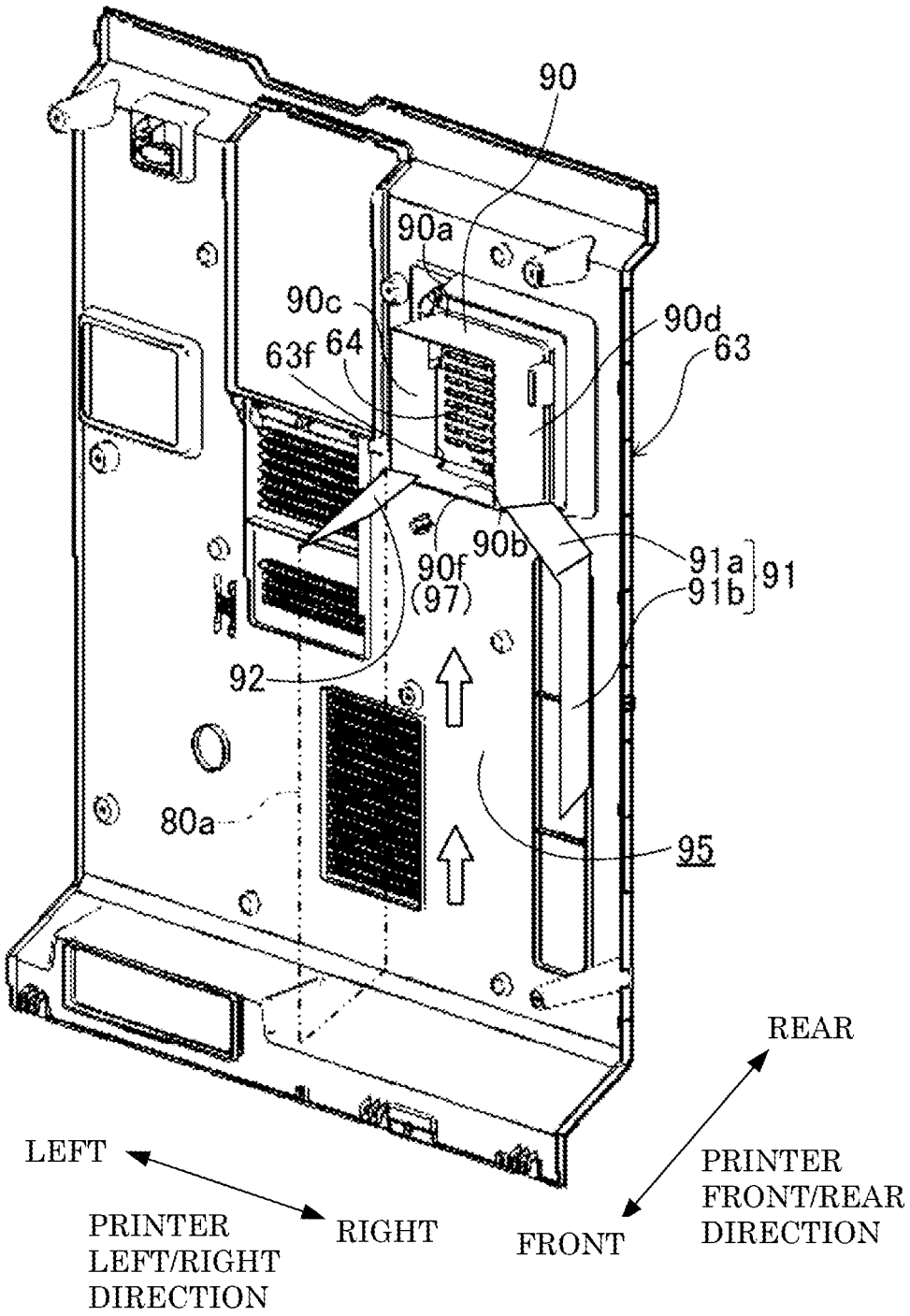
FIG. 7 shows Embodiment 2 of the present invention, corresponding to FIG. 2.

FIG. 7 shows Embodiment 2. Embodiment 2 is different from Embodiment 1 in that it includes guide plates 91, 92 for guiding an airflow into the duct 90. It is noted that the same component elements as those shown in FIG. 5 are assigned the same reference numbers, and description thereof is omitted.

That is, in the present embodiment, a first guide plate 91 and a second guide plate 92 are attached to the bottom wall 90*b* of the duct 90. The first guide plate 91 includes an inclined plate 91*a* and a vertical plate 91*b*. The inclined plate 91*a* is inclined from a right end of the bottom wall 90*b* to a lower right. The vertical plate 91*b* extends from a lower end of the inclined plate 91*a* downward. The second guide plate 92 projects forward from a left end of the bottom wall 90*b*.

In the state where the external cover 63 is attached to the housing 60, a flow guide passage 95 is formed by the external cover 63, the first guide plate 91, the second guide plate 92, the rear sheet metal 62*a*, and a right wall 80*a* of the board box 80. The flow guide passage 95 communicates with the inside of the duct 90 via the cut 90*f*. The flow guide passage 95 guides air around the heat generating equipments 70 to the cut 90*f*, and causes the air to flow into the duct 90 from the cut 90*f*.

As described above, in Embodiment 2, the guide plates 91, 92 are configured to guide high-temperature air around the heat generating equipments 70 to the cut 90*f*. As a result, it is further possible to prevent high-temperature air from remaining around the heat generating equipments.

Embodiment 3

Figure 8:
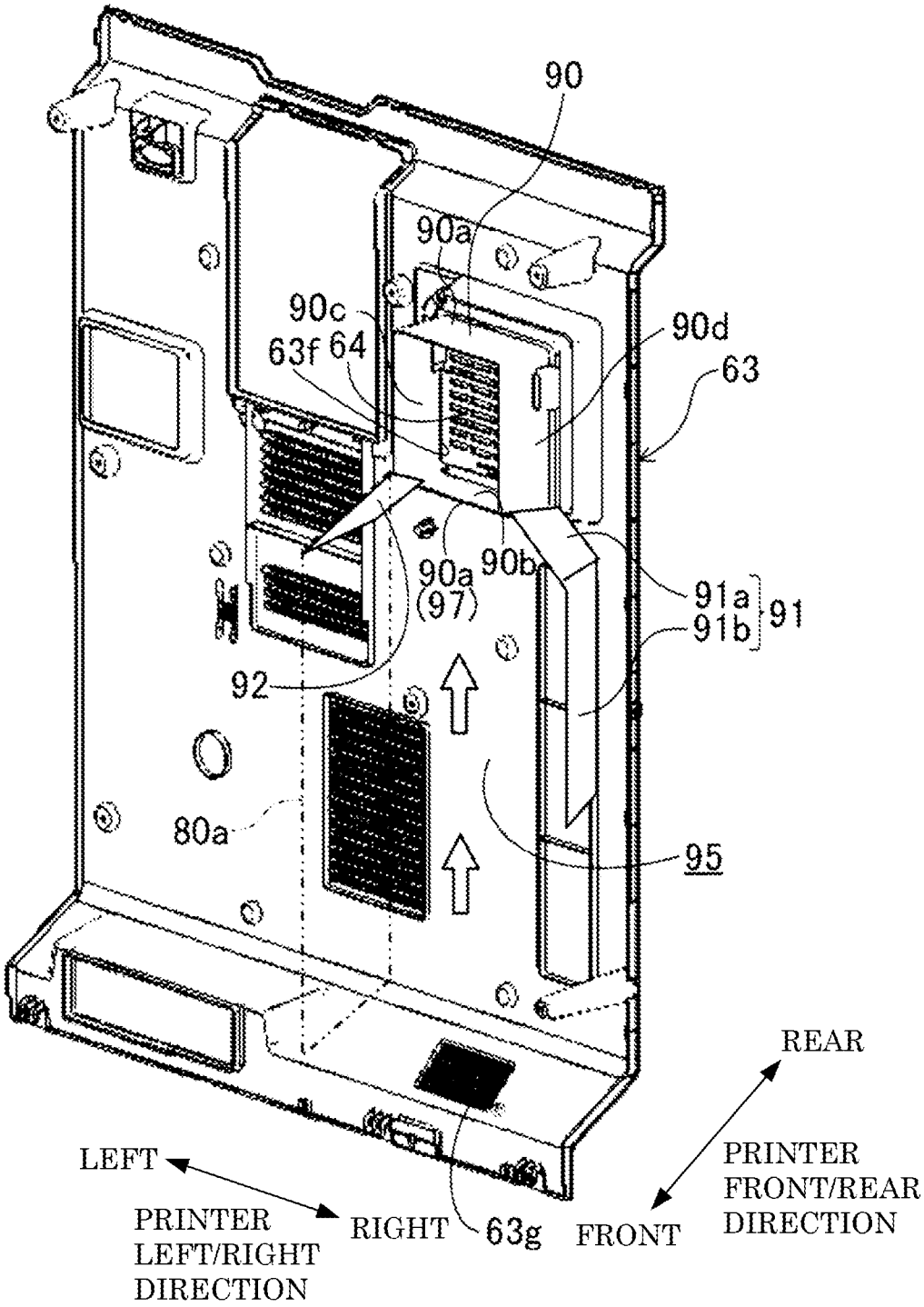
FIG. 8 shows Embodiment 3 of the present invention, corresponding to FIG. 2.

FIG. 8 shows Embodiment 3. Embodiment 3 is different from the above-described embodiments in that the external cover 63 includes an intake opening 63*g*. It is noted that the same component elements as those shown in FIGS. 5 and 7 are assigned the same reference numbers, and description thereof is omitted.

That is, in the present embodiment, the external cover 63 is provided with the intake opening 63*g* in addition to the exhaust outlet 63*f*. The intake opening 63*g* is provided to take in air from the outside of the printer 1 into the equipment storage space S. The intake opening 63*g* is formed in a lower-right part of the external cover 63, below the exhaust outlet 63*f*. The intake opening 63*g* is formed in the external cover 63 at a position close to the sheet feed conveyance motor 71 (a heat generating equipment).

As a result, in Embodiment 3, driving the exhaust fan 100 causes the outside air to flow into the equipment storage space S from the intake opening 63*g* formed in the external cover 63. The outside air that has flown into the equipment storage space S passes the circumference of the heat generating equipments 70, flows into the duct 90 from the cut 90*f* formed in the duct 90, and is discharged to the outside of the printer 1 from the exhaust outlet 63*f*. Accordingly, by providing the intake opening 63*g*, an airflow flowing from the heat generating equipments 70 side to the duct 90 side (from below to above) is formed. It is thus possible to prevent high-temperature air from remaining around the heat generating equipments 70.

In addition, in Embodiment 3, the duct 90 is disposed above the heat generating equipments 70 by paying attention to the fact that the high-temperature air around the heat generating equipments 70 easily rises due to the density difference from the surrounding air. With this configuration, the high-temperature air around the heat generating equipments 70 is easily guided into the duct 90 disposed above the heat generating equipments 70.

Embodiment 4

Figure 9:
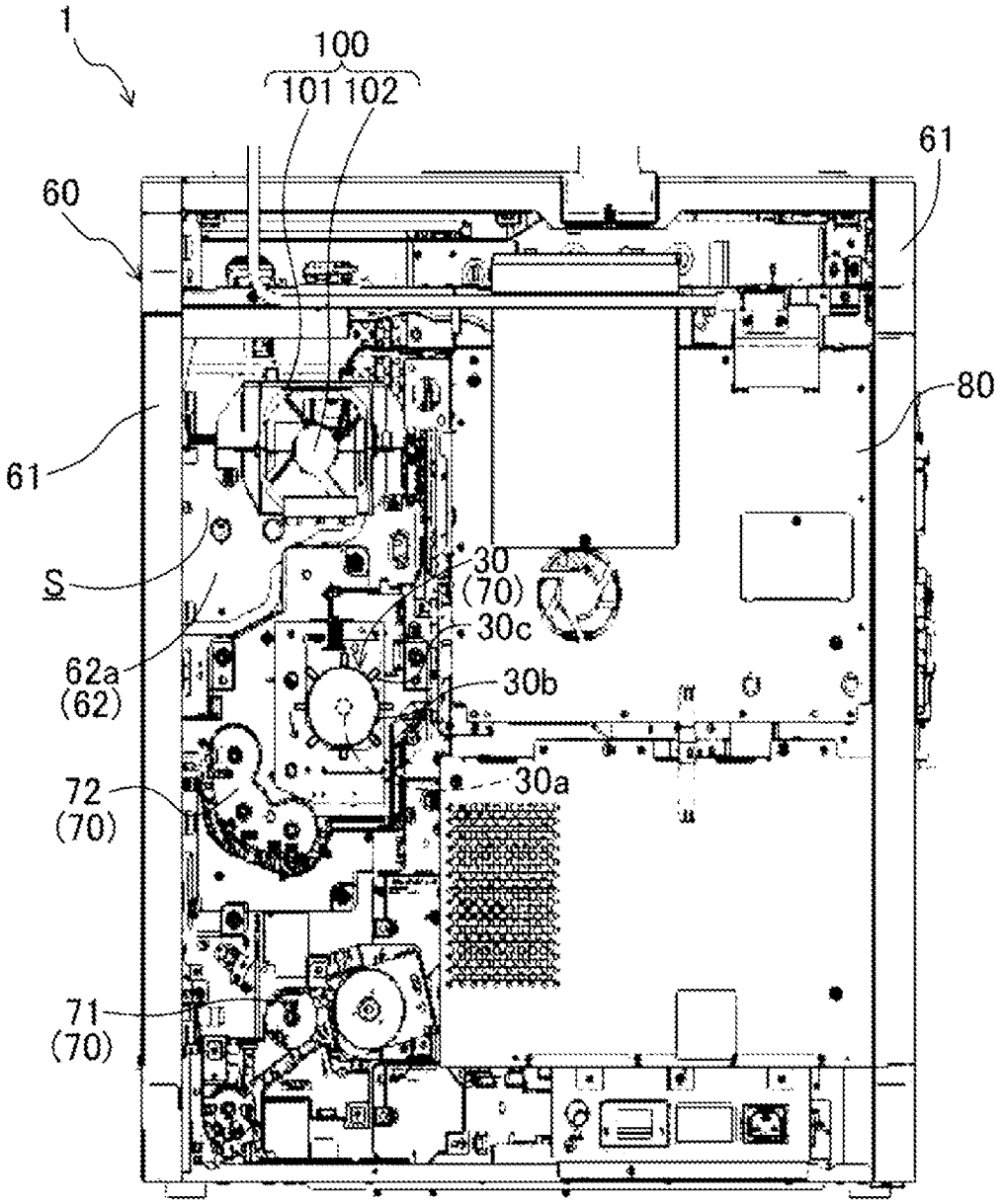
FIG. 9 is a side view, viewed from the rear side, of a printer in Embodiment 4 of the present invention.

FIG. 9 shows Embodiment 4. The present embodiment is different from the above-described embodiments in the configuration of the drum driving motor 30. That is, in the present embodiment, a plurality of impellers 30*c* are formed on the circumferential surface of the rotor 30*b* of the drum driving motor 30. The plurality of impellers 30*c* are formed at equal intervals in the circumferential direction.

With this configuration, the impellers 30*c* rotate together with the rotor 30*b*, thereby airflows are forcibly generated around the drum driving motor 30. As a result, it is possible to further prevent high-temperature air, which has been warmed by the heat of the drum driving motor 30 (a heat generating equipment 70), from remaining around the drum driving motor 30.

Other Embodiments

In the above-described embodiments, as an example of the heat generating equipments 70, the drum driving motor 30, sheet feed conveyance motor 71, and conveyance clutch 72 are explained. However, not limited to this, the heat generating equipments 70 may be composed of, for example, an electric board and the like.

In the above-described embodiments, the communicating portion 97 is composed of the cut 90*f*. However, not limited to this, the communicating portion 97 may be composed of a through hole.

In the above-described embodiments, the duct 93 is fixed to the external cover 63. However, not limited to this, the duct 93 may be fixed to, for example, the rear sheet metal 62*a*.

In the above-described embodiments, the guide plates 91, 92 are fixed to the duct 93. However, not limited to this, the guide plates 91, 92 may be fixed to, for example, the rear sheet metal 62*a*.

In the above-described embodiments, only one exhaust fan 100 is provided However, not limited to this, a plurality of exhaust fans 100 may be provided.

In the above-described embodiments, the laser printer 1 of the electrophotography is explained as an example of the image forming apparatus. However, the present invention is not limited to this. That is, the image forming apparatus may be, for example, an image forming apparatus of the inkjet method. In that case, the image forming portion may include one or more ink heads for ejecting ink onto a paper sheet, and the like.

The present invention is not limited to the above-described Embodiments 1 to 4. The present invention includes configurations made by appropriately combining Embodiments 1 to 4.

The invention claimed is:

1. An image forming apparatus comprising:

a housing storing an image forming portion configured to form an image on a recording medium;

an external cover covering an outer side of a side wall of the housing and having an exhaust outlet formed therein;

an equipment storage space formed between the side wall of the housing and the external cover;

a board box attached to an upper-left part of the side wall of the equipment storage space and storing a board;

an opening formed in the side wall and allowing inside of the housing to communicate with the equipment storage space;

an exhaust fan disposed in the equipment storage space and configured to take in air from the housing via the opening and exhaust the air from the exhaust outlet formed in the external cover;

a heat generating equipment disposed in the equipment storage space; and a duct connecting an air outlet of the exhaust fan and the exhaust outlet formed in the external cover, wherein the heat generating equipment is disposed below the duct, the duct includes a top wall, a bottom wall, a left wall, and a right wall, the top wall and the bottom wall facing each other in an up-down direction, the left wall and the right wall facing each other in a left-right direction, a cut is formed at a center of a front end of the bottom wall in the left-right direction, and in a plan view, the cut is opened toward a front side and is elongated in the left-right direction, a first guide plate and a second guide plate configured to guide air around the heat generating equipment to the cut are provided on the bottom wall, the first guide plate includes an inclined plate and a vertical plate, the inclined plate being inclined from a right end of the bottom wall to a lower right, the vertical plate extending from a lower end of the inclined plate downward, the second guide plate projects forward from a left end of the bottom wall, and a flow guide passage is formed by the external cover, the first guide plate, the second guide plate, the side wall, and the right wall of the board box, the flow guide passage communicating with inside of the duct via the cut.

2. The image forming apparatus according to claim 1, wherein an intake opening is formed in the external cover at a position close to the heat generating equipment, the intake opening being configured to take in air from outside of the image forming apparatus into the equipment storage space.

3. The image forming apparatus according to claim 2, wherein the intake opening is formed below the exhaust outlet.

4. The image forming apparatus according to claim 1, wherein the image forming portion includes an image carrying member configured to carry an electrostatic latent image on a circumferential surface thereof, a developing portion configured to develop, as a toner image, the electrostatic latent image carried on the circumferential surface of the image carrying member, a transfer portion configured to transfer the toner image from the circumferential surface of the image carrying member to the recording medium, and a fixing unit configured to fix the toner image, which has been transferred to the recording medium, to the recording medium by heat, wherein the exhaust fan is attached to the side wall at a position close to the fixing unit.

5. The image forming apparatus according to claim 4, wherein the heat generating equipment is a plurality of heat generating equipments, one of the plurality of heat generating equipments is a motor configured to drive the image carrying member, and the motor includes an output shaft penetrating through the side wall and integrally rotatably coupled with the image carrying member, a cylindrical rotor integrally rotatably coupled with the output shaft in the equipment storage space, and an impeller formed on a circumferential surface of the rotor.

6. A duct provided in an equipment storage space that is provided between a side wall of a housing and an external cover and stores a heat generating equipment, the housing storing an image forming portion configured to form an image on a recording medium, the external cover covering an outer side of the side wall of the housing and having an exhaust outlet formed therein, wherein the side wall has an opening that allows inside of the housing to communicate with the equipment storage space, an exhaust fan, which is configured to take in air from the housing via the opening and exhaust the air from the exhaust outlet formed in the external cover, and a board box attached to an upper-left part of the side wall of the equipment storage space and storing a board, are disposed in the equipment storage space, the duct includes a duct main body connecting an air outlet of the exhaust fan and the exhaust outlet formed in the external cover, the heat generating equipment is disposed below the duct main body, the duct main body includes a top wall, a bottom wall, a left wall, and a right wall, the top wall and the bottom wall facing each other in an up-down direction, the left wall and the right wall facing each other in a left-right direction, a cut is formed at a center of a front end of the bottom wall in the left-right direction, and in a plan view, the cut is opened toward a front side and is elongated in the left-right direction, a first guide plate and a second guide plate configured to guide air around the heat generating equipment to a communicating portion of the duct main body are provided on the bottom wall, the first guide plate includes an inclined plate and a vertical plate, the inclined plate being inclined from a right end of the bottom wall to a lower right, the vertical plate extending from a lower end of the inclined plate downward, the second guide plate projects forward from a left end of the bottom wall, and a flow guide passage is formed by the external cover, the first guide plate, the second guide plate, the side wall, and the right wall of the board box, the flow guide passage communicating with inside of the duct main body via the cut.

* * * * *